United States Patent [19]

Cowen et al.

[11] 4,376,084

[45] Mar. 8, 1983

[54] PROCESS FOR THE PRODUCTION OF HETEROGENEOUS ARTICLES

[75] Inventors: Geoffrey Cowen, Runcorn, England; Philip Norton-Berry, Llandegla, Wales; Margaret L. Steel, Runcorn, England

[73] Assignee: Imperial Chemical Industries Limited, London, England

[21] Appl. No.: 235,156

[22] Filed: Feb. 12, 1981

[30] Foreign Application Priority Data

Feb. 21, 1980 [GB] United Kingdom ..... 8005839

[51] Int. Cl.[3] ..... B22D 23/08

[52] U.S. Cl. ..... 264/8; 264/171; 264/211; 425/8

[58] Field of Search ..... 425/8; 264/8, 171, 211

[56] References Cited

U.S. PATENT DOCUMENTS

| | | | |
|---|---|---|---|
| 3,288,052 | 11/1966 | Hough | 118/303 |
| 3,400,189 | 9/1968 | Nacke | 264/8 |
| 3,429,953 | 2/1969 | Crompton | 264/8 |
| 3,596,312 | 8/1971 | Ohmatsu | 264/8 |
| 4,106,921 | 8/1978 | Porter | 264/8 |
| 4,111,673 | 9/1978 | Natta | 264/8 |
| 4,178,336 | 12/1979 | Shoudea | 264/8 |
| 4,197,063 | 4/1980 | Davidson | 264/8 |

FOREIGN PATENT DOCUMENTS

| | | | |
|---|---|---|---|
| 43-15597 | 7/1968 | Japan | 264/8 |
| 44-902 | 1/1969 | Japan | 264/8 |
| 1540171 | 2/1979 | United Kingdom . | |

*Primary Examiner*—Jay H. Woo

*Attorney, Agent, or Firm*—Cushman, Darby & Cushman

[57] ABSTRACT

A process for the production of heterogeneous articles such as heterofilaments and fibres containing a plurality of solid phases, comprises supplying a thermoplastic first material in particulate solid form to a surface of rotation of a rotating body so that it travels across said surface towards a discharge zone due to forces generated by the rotation of the body, melting the thermoplastic first material as it travels across the surface, supplying a second solid material to the surface, discharging both materials together from the discharge zone by centrifugal forces, and solidifying the thermoplastic material to form the heterogeneous article. The second material is preferably also thermoplastic and further solids, especially reinforcing fibres, can also be incorporated likewise.

12 Claims, 4 Drawing Figures

PROCESS FOR THE PRODUCTION OF HETEROGENEOUS ARTICLES

This invention relates to the production of heterogeneous solid articles.

According to the present invention there is provided a process for the production of heterogeneous articles containing a plurality of solid phases, wherein the process comprises supplying a thermoplastic first material in particulate solid form to a surface of rotation of a rotating body so that it travels across said surface towards a discharge zone due to forces generated by the rotation of the body, melting the thermoplastic first material as it travels across the surface, supplying a second solid material to the surface so that it also travels across the surface in like manner to reach the discharge zone with the molten first material, discharging the materials together from the discharge zone of the surface by centrifugal forces, and causing or allowing the thermoplastic first material to solidify and form the heterogeneous article thereby.

Heterogeneous articles which can be made in this way include films, platelets, short fibres, longer filaments and powder which are coated or impregnated with another solid material. For example, thermoplastic fibres may be impregnated with graphite or be formed with cores of graphite particles to render them electrically conducting. A process of particular utility is one wherein the second material is also a thermoplastic material, especially one wherein the second thermoplastic material is also melted as it travels across the surface towards the discharge zone. In this case articles such as laminated films, heterogeneous fibre mats, heterofilaments and heterogeneous polymer particles containing a shell and a core may be produced according to the conditions prevailing when they are discharged. Fibres and films may be orientated in the discharging process by means either of the forces operating from the rotating body as they leave the surface or by collecting means, such as wind-up apparatus arranged cylindrically around the rotating body, for example.

For many applications, two different solid materials are sufficient. However it is intended that the invention should not be restricted to two materials only, as very useful properties can be obtained by supplying to the surface at least one other solid material in addition to the said first and second materials. Thus for example a heterofilament can be produced with fibres or other fillers distributed throughout one or both of the layers.

The solid materials according to the invention are supplied to the surface in a solid form which will travel across the surface. These include free-flowing powders, granules and pellets which are themselves inherently fluent under the forces generated by the rotation of the body. Chopped films and fibres may also be inherently fluent under appropriate conditions. Solid materials which are not by themselves sufficiently fluent to travel readily across the surface, may be carried by inherently fluent materials previously supplied to the surface. Materials which may have difficulty in flowing, include fine cohesive powders and solids in coarse lumpy form, such as large granules, crystals, grindings or merely irregular broken pieces. Where these are supplied to a surface across which is already flowing a thermoplastic melt, for example, they may, under appropriate conditions, be induced to flow with the melt across the surface and participate in a process of the present invention, even though they would not flow readily on their own.

The solid materials may be supplied altogether to a single zone of the surface, either premixed or supplied separately through separate or co-axial pipes: the result generally being the same provided the distance of travel across the surface is sufficient for the mixture to reach equilibrium. This will usually be in the form of layers as the differences in physical properties, e.g. melt viscosity and density, affect the flow. The different solid materials can alternatively be added sequentially. This will not normally affect the establishment of the same layered structure (and hence the same product), except when the materials have very similar physical properties under the environmental conditions on the surface, or when one material is supplied so close to the discharge zone that there is insufficient time for the layers to become established.

Thus for example, when spinning heterofilaments from the internal surface of a cylinder which flares out to a smooth discharge rim at one end, the more dense material forms an outer layer next to the surface. As this layered structure discharges as a filament, the layer next to the surface forms a core around which the other layer closes to form a sleeve. Where two very similar materials are used, such as polyethylene and polypropylene, if either is allowed to establish a layer of melt against the surface before the other is added, it will tend to provide a core around which the other forms a sleeve. Other factors such as the shape of the discharge zone can also affect the resulting article, by preventing the upper layer from closing around the lower layer, for example. The result may then be a filament formed of two materials attached side-by-side, e.g. with different properties of elasticity, shrink or thermal expansion.

A variety of body shapes is possible, ranging from a flat plate having a surface of rotation orthogonal to the axis to a hollow cylinder having an internal surface of rotation at a constant radial distance from the axis and having an axial component. Fluent material on a rotating flat plate moves outwards away from the axis, until it reaches the periphery from which it is discharged by centrifugal forces. Fluent material on the internal surface of a rotating cylinder spreads out until it reaches the periphery at one end of the cylinder and is then discharged by centrifugal forces. In the cylinder, the supply zone (i.e. the zone to which one or more of the materials is supplied) will be axially displaced from the discharge zone. For a flat spinning disc there is no such axial displacement, and we find the process to be more difficult to control without such axial displacement.

Preferred shapes include cylinders, cones, bowls and other hollow shapes having internal surfaces of rotation with a supply zone mutually displaced axially from a discharge zone. (For this purpose the supply zone may be any zone displaced from a discharge zone and positioned such that fluent material placed thereon will flow towards a discharge zone impelled solely by forces generated by rotation of the body, a discharge zone being a zone from which centrifugal forces generated by that same rotation will discharge the material from the surface.) Bodies especially preferred are bowls having an internal surface of rotation which is substantially cylindrical or frustoconical with an internal angle less than 15°, closed at one end (this being the narrower end in the case of a frusto-cone) and flared outwards to a wider coaxial rim at the other end. When rotated about a central axis, the rim provides a discharge zone. Material is preferably supplied to the surface at or near the closed end to maximise the axial displacement from the discharge zone, but further material may be added at other zones nearer the rim.

For the production of film, a smoothly circular rim is preferred. For the production of fibres, a rim having a plurality of radial channels for dividing material travelling across the surface into discrete streams, can improve the uniformity of the fibres. Alternatively a discharge zone may comprise a plurality of holes or slots in the surface, being arranged so that the material travelling across the surface is flung through them by the centrifugal forces, and thereby discharged. However, for most applications the simplicity of suitably shaped peripheral discharge rim appears not to be associated with any disadvantages over a row of suitably shaped apertures, and is therefore preferred.

The forces operating on the fluent material causing it to move on the surface do not depend solely on the speed of rotation, but they depend also on the physical dimensions of the rotating body, e.g. the radius and angle the surface makes with the axis of rotation. The centrifugal force may be measured as the acceleration of the fluent material on the surface of rotation and for our process accelerations of at least 100 m $sec^{-2}$ are most suitable, accelerations greater than 400 m $sec^{-2}$ being preferred. The speed of rotation may vary over a wide range, e.g. from 50 rpm up to 100,000 rpm, but the range we have found most useful is from 1000 to 30,000 rpm.

The surface of rotation is preferable formed from a rigid inert material such as glass, plastics or a chemically resistant metal such as stainless steel, nickel, titanium and tantalum. Other materials may be coated with chemically resistant surface materials such as glass, silicone resins or polytetrafluoroethylene. A cheap form of bowl may be obtained by using a flexible film, this becoming suitably rigidified during rotation at high speed.

The invention is illustrated by reference to the specific forms of rotating bodies shown in the accompanying drawings and by examples of the process as carried out in a preferred apparatus. In the drawings, FIG. 1 is a diagramatic cross section through a preferred apparatus used to carry out the examples described hereinafter.

Figure 1:
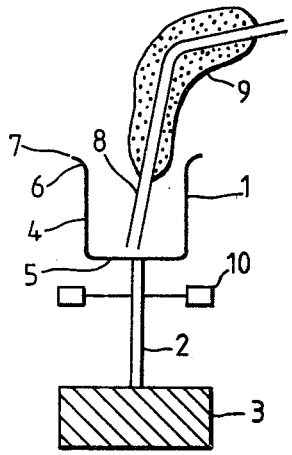

In the apparatus of FIG. 1, a hollow circular bowl 1 is coaxially mounted on a drive shaft 2 of an electric motor 3. The sides 4 of the bowl are substantially cylindrical in configuration, with the lower end 5 closed to form the base of the bowl, and the upper end 6 flared outwards to an annular rim 7 at the periphery of the surface. A delivery tube 8 extends deep into the bowl, and carries an insulating jacket 9. Below the bowl, a fan 10 is also mounted on the drive shaft.

In operation the bowl is rotated at high speed, e.g. 1000–5000 rpm. A free flowing powder is supplied down the tube, falling onto the base where it spreads out under centrifugal forces generated by rotation of the bowl and transmitted to the powder by friction. As further powder is supplied and the rotation continues, the powder travels up the walls of the bowl to the flare, where it moves outward to be discharged from the rim by centrifugal forces. Another powder is sprayed onto the layer travelling up the surface of the bowl, becomes entrained and travels with it to the discharge zone at the rim. As the bowl rotates, the fan blows hot air against the sides of the bowl to raise the temperature above the softening temperature of at least one of the two powdered materials travelling across the surface, while the insulating jacket prevents partial melting of the solid in the supply tube, which might otherwise cause a blockage. As the mixture leaves the bowl, it is flung rapidly through this stream of hot air, e.g. as fibres or droplets, and is allowed to cool and solidify once more.

The two powdered materials may alternatively be supplied simultaneously as a mixture through a common tube, or one powder may be supplied through a hole in the base of the bowl while the other is supplied through a supply pipe from above as depicted.

The operation of the above embodiment is illustrated by the following Examples.

EXAMPLE 1

A stainless steel bowl was rotated about a vertical axis at 2000 rpm. The bowl was heated to 140° C. and polyethylene powder was melted in the centre of the base of the bowl. As a thin film of the molten polyethylene travelled across the surface of the bowl, a fine powder of polypropylene was sprayed onto the moving film. The molten polyethylene was discharged by centrifugal force from the rim of the bowl as fibres, and these were observed to be coated with particles of the powdered polypropylene.

The temperature of the bowl was raised to 300° C. and the experiment repeated. The product was observed to consist of polyethylene fibres coated with a sleeve of polypropylene which acted as a protective tube around the central core of polyethylene.

The temperature of the bowl was maintained at ca. 270° C. and the polypropylene was brought into contact with the surface of the bowl prior to the polyethylene. After a thin film of polypropylene was established on the surface, the polyethylene powder was added to the molten film of polypropylene and in this case the product consisted of a fibre having a central core of polypropylene and a sleeve of polyethylene.

EXAMPLE 2

Polyethylene powder was supplied to the base of a stainless steel bowl rotating at 1000 rpm and maintained at 140° C. Carbon black was added to the surface of the polyethylene film which had established itself on the surface of the bowl. The carbon black powder and the polyethylene film travelled together in intimate contact towards the periphery of the bowl from which they were discharged together. Fibres of polyethylene were produced coated with an external layer of carbon black which adhered well due to some impregnation of carbon into the surface layer of each polyethylene fibre.

EXAMPLE 3

With the stainless steel bowl rotating at 2000 rpm and heated to 270° C., glass filled polypropylene was supplied to the base of the bowl. The polypropylene melted and moved upwards as a thin film, carrying with it the glass filler. Polyethylene powder was added to the film and the mixture discharged from the rim as fibres. These were found to have a core of glass filled polypropylene surrounded by a sleeve of polyethylene.

EXAMPLE 4

The stainless steel bowl was again rotated at 2000 rpm, and heated. A mixture of carbon fibre filled nylon and polypropylene powder was fed to the base of the bowl, and the temperature adjusted with good flow over the surface was obtained. The articles produced as the mixture was discharged were heterofilaments having a core of fibre filled nylon surrounded by a sleeve of polypropylene. The carbon fibres appeared to be aligned along the filaments.

The bowl was then cooled to freeze the material travelling up the surface. This was found to be in two layers which became quite separate on cooling. The inner layer (i.e. the layer remote from the surface) was polypropylene, which showed a pronounced transition about halfway up the surface where it changed from an opaque white uneven material to a translucent layer which had presumably been melted. The outer layer (which had been adjacent to the surface) was a carbon fibre filled nylon, with the black fibres visibly aligned at least in the upper portion as the materials approached the discharge rim.

EXAMPLE 5

The stainless steel bowl of the previous Example was replaced by one having a plurality of radial channels for dividing into discrete streams, the materials travelling across the surface towards the discharge rim, and the process of that Example repeated. Heterofilaments were again produced, but the fibre-filled nylon and the polypropylene lay side-by-side rather than one sleeved within the other. Unlike the material from the cooled surface in the previous Example, the two layers seemed to adhere well, i.e. without the previous delamination, and this may have been due to partial encircling of the nylon by the polypropylene. However, as both materials were exposed along the length of the filaments, we class them as "side-by-side" heterofilaments to distinguish them from those consisting of a sleeved core, whether one material was wrapped partially around the other, or whether they had minimal contact.

In the Examples, the means used to control the temperature of the surface, was hot air as described. However, this was an experimented rig and other forms of heating, such as by induction, electrical resistance or infra red radiation, may provide equally effective control more conveniently.

Figure 2:
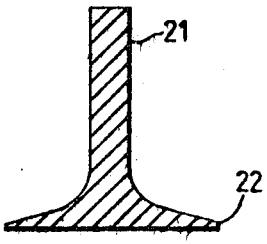
FIG. 2 is a section through a solid rotating body.
Figure 3:
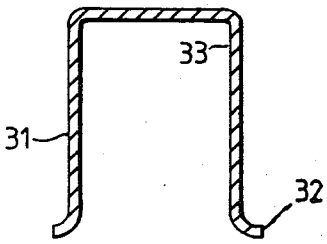
FIG. 3 is a section through a hollow vessel used to provide a rotating surface.
Figure 4:
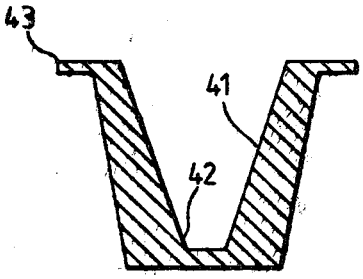
FIG. 4 is a section through a further hollow vessel.

FIGS. 2 to 4 show three basic shapes of rotating body as examples of different approaches to this subject. The body of FIG. 2 is solid with an external surface of rotation for mixing and melting the materials. This can be used by inserting the upper end 21 through the base of a hopper so that solid thermoplastic powder is supplied continuously against its surface. The body is maintained at a temperature above the melting point of the powder, which then melts and is carried along the surface from the supply zone 21 to the rim 22 by forces due to rotation of the body, and is there discharged.

However we find that for many purposes a process on an external surface is more difficult to control than one on an internal surface, and we prefer to use internal walls of hollow bodies. FIGS. 3 and 4 show very convenient shapes which between them will cope with most materials. The body of FIG. 3 is substantially the same bowl shape as that shown in FIG. 1, except that it is inverted. The walls 31 are cylindrical over most of their length and the corners are smoothly rounded, with the open end flared out to a discharge zone 32 at the rim. In this inverted attitude, solids may conveniently be thrown onto the surface of rotation by a conical member rotating in synchronisation within the bowl. Solid powder fed to the conical surface, either through an axial hole in the bowl or up a supply tube to the apex of the cone, is accelerated by the rotating cone through friction, and flung against the inner surface of the bowl by centrifugal forces. There is is held, and caused to travel over the surface of the bowl by the rotation, from the zone 33 to which it was supplied, to the discharge zone 32.

The bowl of FIG. 4 is similar except that the internal surface of rotation 41 is frusto-conical in shape. This can be helpful for highly viscious materials in that a thinner layer, giving improved heat transfer, can be obtained for the same throughput without having to resort to excessively high rates of rotation. Like the preceding drawing, material supplied to the narrow closed end 42 (a supply zone) will travel across the surface due to the rotation, to be discharged around the rim 43. When used with the rim uppermost as depicted, solid powder can simply be piped to the base of the bowl. When used inverted, a conical feeder as described in connection with FIG. 3 equipment, can be helpful.

A variety of intermediate shapes which also provide axial travel, but which are variously curved axially instead of being axially straight as in a cylinder or cone, can also be suitable. Gentle smooth curves, e.g. a parabolic shape, are preferred.

In all these examples, the other materials may be added part way along the surface, i.e. between the supply zone identified and the discharge zone. This may be advantageous when a solid is to be added to a molten thermoplastic in allowing time for melting to occur. Otherwise, the materials can all be added together as early as possible to maximise their contact in the form they are to be discharged, and thereby improve the stability of the process in the most efficient manner.

What we claim is:

1. A process for the production of heterogeneous articles containing a plurality of solid phases, wherein the process comprises supplying a thermoplastic first material in particulate solid form to a surface of rotation of a rotating body, the surface of rotation having a coaxial discharge rim around its periphery and the first material being supplied to the surface so that it is caused to travel across said surface towards the rim by forces generated by the rotation of the body, melting the thermoplastic first material as it travels across the surface, supplying a second solid material to the surface so that it also travels across the surface in like manner to reach the rim with the molten first material, discharging the materials together from the rim of the surface by centrifugal forces, and causing or allowing the thermoplastic first material to solidify and form the heterogeneous article thereby.

2. A process according to claim 1 in which the second material is also a thermoplastic material.

3. A process according to claim 2 which comprises melting the second thermoplastic material as it travels across the surface towards the rim.

4. A process according to any one of the preceding claims which comprises supplying to the surface at least one other solid material in addition to the said first and second materials.

5. A process according to claim 4 in which a fibrous material is supplied to the surface in addition to the said first and second materials.

6. A process according to claim 1 in which the surface of rotation is an imperforate internal surface of a hollow body and has a supply zone axially displaced from the discharge zone, the discharge rim being imperforate and flaring radially outwardly from said internal surface.

7. A process according to claim 6 in which the body is a bowl having an internal surface of rotation which is substantially cylindrical or frustoconical with an internal angle less than 15°, being closed at one end, this being the narrower end in the case of a frusto-cone, and being flared outwards to the coaxial rim at the other end.

8. A process according to claim 7 in which the rim is smoothly circular.

9. A process according to claim 7 in which the surface has a plurality of radial channels for dividing materials travelling across the surface into discrete streams.

10. A process according to claim 3 in which the articles produced are heterofibres or heterofilaments comprising a core of a first thermoplastic material surrounded by a sleeve of a second thermoplastic material.

11. A process according to claim 3 in which the articles produced are heterofibres or heterofilaments comprising at least two layers of different thermoplastic materials attached side-by-side.

12. A process according to claim 10 or 11 in which at least one of the two thermoplastic materials is fibre-filled.

* * * * *